US010617206B2

(12) United States Patent
Brügmann

(10) Patent No.: US 10,617,206 B2
(45) Date of Patent: Apr. 14, 2020

(54) SYSTEM INCLUDING ARTICLE SUPPORT SURFACE AND DIVIDERS

(71) Applicant: Bruegmann GmbH & Co. KG, Hagen (DE)

(72) Inventor: Lars Brügmann, Dortmund (DE)

(73) Assignee: Bruegmann GmbH & Co. KG, Hagen (DE)

( * ) Notice: Subject to any disclaimer, the term of this patent is extended or adjusted under 35 U.S.C. 154(b) by 0 days.

(21) Appl. No.: 16/194,605

(22) Filed: Nov. 19, 2018

(65) Prior Publication Data

US 2019/0183243 A1 Jun. 20, 2019

(30) Foreign Application Priority Data

Dec. 14, 2017 (EP) ..... 17207265

(51) Int. Cl.
*A47B 57/58* (2006.01)
*A47F 5/00* (2006.01)

(52) U.S. Cl.
CPC ..... *A47B 57/588* (2013.01); *A47F 5/005* (2013.01)

(58) Field of Classification Search
CPC ..... A47B 65/00; A47B 65/15; A47B 65/20; A47B 57/58; A47B 57/583; A47B 57/588; A47B 96/04; A47F 5/005; A47F 7/144; A47F 5/132
USPC ..... 211/42, 151, 59.2, 59.3, 126.15, 85.8; 108/60, 61
See application file for complete search history.

(56) References Cited

U.S. PATENT DOCUMENTS 1,277,827 A * 9/1918 Barber ..... A47C 29/006 135/137
1,523,136 A * 1/1925 O'Connor ..... B25H 3/06 206/558
2,309,896 A * 2/1943 Gustafson ..... B65D 25/04 119/52.4
2,884,139 A * 4/1959 Dunham ..... A47F 5/005 211/10
2,915,193 A * 12/1959 Bromberg ..... A47F 5/005 108/61
2,933,195 A * 4/1960 Radek ..... A47B 57/58 211/153

(Continued)

FOREIGN PATENT DOCUMENTS

DE 20122477 U1 12/2005
WO 0176417 A1 10/2001

*Primary Examiner* — Jonathan Liu
*Assistant Examiner* — Devin K Barnett
(74) *Attorney, Agent, or Firm* — Medley, Behrens & Lewis, LLC

(57) ABSTRACT

The following invention relates to a system comprising: an article support surface for the arrangement of articles on a front end of the article support surface, having an article track whose track width is delimited and adjustable by at least two dividers having one front fixing element and one rear fixing element, at least one article track whose track width is delimited and adjustable laterally by the dividers, a front fixing section arranged at the front end for fixing the front fixing element and a rear fixing section arranged at a rear end of the article support surface for fixing the rear fixing element characterized in that the rear fixing element has a rear attachment lug facing towards the front fixing element.

11 Claims, 5 Drawing Sheets

(56) References Cited

Figure 1A:
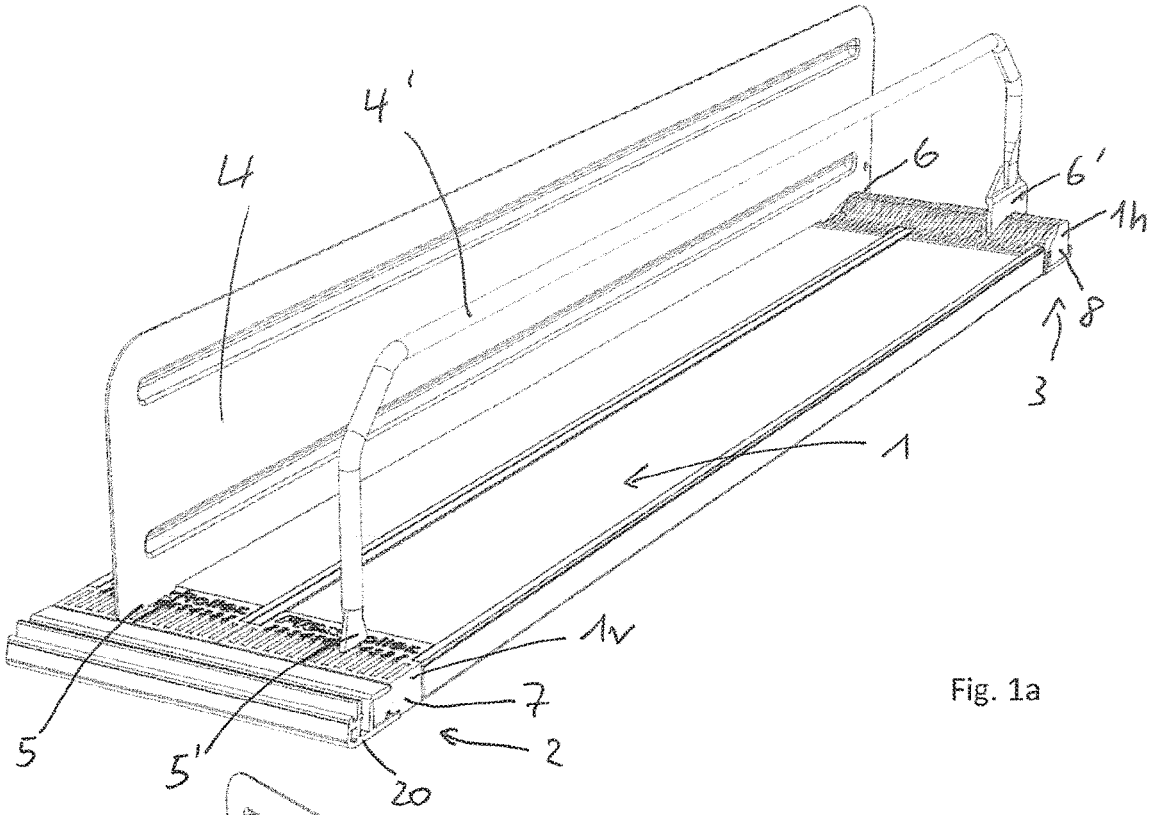

U.S. PATENT DOCUMENTS 3,559,815 A * 2/1971 Huddleston ..... A47F 5/005 211/184
3,608,741 A * 9/1971 Schray ..... A47F 5/005 211/184
3,698,568 A * 10/1972 Armstrong ..... A47F 5/005 211/184
3,703,964 A * 11/1972 Field ..... A47F 5/005 211/184
3,872,976 A * 3/1975 Moore ..... A47F 5/005 211/184
3,905,484 A 9/1975 Dean et al.
4,476,985 A * 10/1984 Norberg ..... A47F 5/005 211/133.6
4,488,653 A * 12/1984 Belokin ..... A47F 5/005 108/61
4,519,508 A * 5/1985 Gullett ..... A47B 57/04 108/107
4,733,782 A * 3/1988 Spezial ..... A47F 5/0876 211/106.01
5,161,704 A * 11/1992 Valiulis ..... A47F 5/005 108/61
5,381,908 A * 1/1995 Hepp ..... A47B 57/585 108/61
6,082,557 A * 7/2000 Leahy ..... A47B 57/58 211/184
6,098,821 A 8/2000 Dube et al.
RE38,517 E * 5/2004 Pfeiffer ..... B65G 1/023 193/35 R
7,128,379 B1 * 10/2006 LaBonia, Jr. ..... A47B 47/0075 312/351
D541,563 S * 5/2007 LaBonia, Jr. ..... D6/705
7,628,282 B2 * 12/2009 Hardy ..... A47F 1/126 211/151
7,743,932 B2 * 6/2010 Lynch ..... A47F 5/0056 211/181.1
7,934,609 B2 * 5/2011 Alves ..... A47F 5/005 211/184
8,016,128 B2 * 9/2011 Valiulis ..... A47F 1/126 211/59.3
8,287,060 B1 * 10/2012 Golias, Jr. ..... A47B 47/025 108/60
8,322,545 B1 * 12/2012 Golias, Jr. ..... A47B 96/021 211/119.003
8,413,825 B2 * 4/2013 Spizman ..... A47B 57/045 211/150
8,915,381 B2 * 12/2014 Brozak ..... A47F 7/0021 108/61
8,978,904 B2 * 3/2015 Hardy ..... A47F 1/126 211/184
9,038,804 B1 * 5/2015 Nickell ..... B65G 13/11 193/35 R
9,129,494 B2 * 9/2015 Valiulis ..... G08B 13/14
9,364,103 B2 * 6/2016 Crabtree, II ..... A47B 57/58
9,392,887 B2 * 7/2016 Nilsson ..... A47B 57/58
2001/0002659 A1 * 6/2001 Bada ..... A47B 57/583 211/59.2
2002/0088762 A1 * 7/2002 Burke ..... A47F 1/126 211/59.3
2003/0034319 A1 * 2/2003 Meherin ..... A47F 5/005 211/184
2003/0132178 A1 * 7/2003 Jay ..... A47B 96/021 211/59.2
2003/0141265 A1 * 7/2003 Jo ..... A47F 1/126 211/59.3
2004/0011754 A1 1/2004 Zadak
2004/0245197 A1 * 12/2004 McElvaney ..... A47F 1/125 211/184
2005/0077260 A1 * 4/2005 Mueller ..... A47F 1/126 211/59.3
2005/0224437 A1 * 10/2005 Lee ..... A47F 5/005 211/184
2006/0021957 A1 * 2/2006 Hardy ..... A47F 1/126 211/59.3
2006/0113262 A1 * 6/2006 Knorring, Jr. ..... A47F 1/121 211/59.2
2007/0029270 A1 * 2/2007 Hawkinson ..... A47F 1/126 211/59.3
2007/0175844 A1 * 8/2007 Schneider ..... A47F 5/005 211/184
2007/0273258 A1 * 11/2007 Ernst ..... A47B 88/994 312/348.3
2008/0203256 A1 * 8/2008 Medcalf ..... A47F 1/126 248/231.81
2010/0072152 A1 * 3/2010 Kim ..... A47F 1/12 211/151
2010/0078402 A1 * 4/2010 Davis ..... A47B 57/585 211/184
2010/0133214 A1 * 6/2010 Evans ..... A47B 31/00 211/85.8
2010/0133219 A1 * 6/2010 Sun ..... A47F 1/125 211/151
2010/0206829 A1 * 8/2010 Clements ..... A47F 1/12 211/162
2010/0252519 A1 * 10/2010 Hanners ..... A47F 5/005 211/184
2010/0258513 A1 * 10/2010 Meyer ..... A47F 1/126 211/59.3
2011/0174750 A1 * 7/2011 Poulokefalos ..... A47F 1/126 211/59.3
2011/0186401 A1 * 8/2011 Brugmann ..... A47F 1/125 193/37
2011/0309044 A1 * 12/2011 Morrow ..... A47F 5/005 211/59.2
2012/0211327 A1 * 8/2012 Brugmann ..... A47F 5/0093 193/35 R
2012/0217212 A1 * 8/2012 Czalkiewicz ..... A47F 1/12 211/59.2
2013/0015155 A1 * 1/2013 Brugmann ..... A47F 1/12 211/151
2013/0020270 A1 * 1/2013 Valiulis ..... A47F 5/005 211/59.2
2013/0075352 A1 * 3/2013 Mitten ..... A47F 5/005 211/59.2
2013/0112640 A1 * 5/2013 Desmond ..... A47B 96/021 211/153
2013/0153524 A1 6/2013 Nilsson
2014/0034590 A1 * 2/2014 Szpak ..... A47F 1/04 211/59.2
2014/0263112 A1 * 9/2014 Bird ..... A47F 1/04 211/59.2
2014/0263134 A1 * 9/2014 Walker ..... A47F 5/005 211/184
2014/0299560 A1 * 10/2014 Kim ..... A47F 1/126 211/59.2
2014/0374368 A1 * 12/2014 Crabtree, II ..... A47F 5/005 211/153
2015/0114918 A1 * 4/2015 Nickell ..... B65G 13/11 211/59.2
2015/0157142 A1 * 6/2015 Turner ..... A47F 1/125 211/59.3
2015/0359358 A1 * 12/2015 Miller, Jr. ..... A47F 5/005 211/59.2
2016/0073776 A1 * 3/2016 Zeidner ..... A47B 57/588 211/134
2016/0150878 A1 * 6/2016 Clark ..... B65G 1/02 211/184
2017/0127853 A1 * 5/2017 Colelli ..... A47F 1/126
2018/0184814 A1 * 7/2018 Nagel ..... A47F 1/126

* cited by examiner

SYSTEM INCLUDING ARTICLE SUPPORT SURFACE AND DIVIDERS

RELATED APPLICATION

This application claims priority to European Patent Application No. 17207265, filed Dec. 14, 2017, the entirety of which is incorporated herein by reference.

DESCRIPTION

The present invention relates to a system according to patent claim 1 and a divider according to patent claim 10.

In the systems known hitherto, the fitting of dividers on shelves or article support surfaces inserted in shelving racks has often proven to be complicated, particularly in the case of deep shelving racks. As soon as the width of the article track is to be changed or if the rack is to be cleaned thoroughly, the dividers must be taken out. In most cases, it is at least necessary to release a connector on the rear end of the shelf in order to be able to take the dividers. This is particularly arduous with the top and bottom shelves.

The object of the present invention is to provide a system which is as simple as possible to manipulate, but at the same time is also of stable design and constructed so that it can be integrated with little space requirement in existing shelving rack systems.

This object is solved with the features of patent claims 1 and 10. Advantageous refinements of the invention are described in the subordinate claims. The scope of the invention further extends to all combinations of at least two of the features defined in the description, the claims and/or the figures. Where value ranges are given, all values lying within the specified limits are also to be considered as limit values and claimable in any combination.

The invention is based on the idea of constructing the dividers, particularly the rear end thereof, in such a way that when it is fitted in an insertion position the divider only has to be grasped at the front end.

In particular, the divider is designed with the formation of a rear fixing element with a rear attachment lug directed towards a front fixing element, so that first the rear attachment lug may be inserted, particularly hooked, into the article support surface, before the front fixing element is fixed to the article support surface.

According to an advantageous embodiment, the rear attachment lug has an upper attachment face which slopes downwards towards the front, particularly with respect to the article support surface or a feed direction of the articles. Because the attachment face slopes downward towards the front, the divider may be fixed in the attachment position when attaching to the rear fixing section by pulling the divider forwards. The pulling force may be exerted from the front end of the divider without having to take hold of the divider at the rear end.

According to an alternative aspect of the invention, which in particular may be considered inventive on its own merits, the divider designed by shaping a rear fixing element with a rear attachment lug which is directed away from a front fixing element, wherein the rear attachment lug may also be inserted, particularly hooked into the article support surface first, before the front fixing element is attached to the article support surface.

According to an advantageous embodiment, the rear attachment lug has an upper attachment face which slopes downwards towards the rear, particularly with respect to the article support surface or to a direction of feed of the articles.

Since the attachment face slopes downwards to the rear, the divider may be fixed in the attachment position when attaching to the rear fixing section by pushing the divider backwards. The pushing force may be exerted from the front end of the divider without having to take hold of the divider at the rear end.

The installation procedure is improved further if a lower attachment face is provided that slopes downwards and/or is aligned parallel to the upper attachment face. When the divider is pushed in, it may be advanced over the rear fixing section by the lower attachment face functioning as a leading slope with no additional force applied, or without having to be raised. As soon as the rear attachment lug is advanced beyond the rear fixing section, it falls downwards and can be fixed in place with the pulling movement described earlier.

According to an advantageous variant, this takes place in such manner that the rear fixing section has a row of rear insertion pockets with insertion pocket opening that face to the rear. The attachment lugs are pulled into these, particularly in conjunction with the upper attachment face.

Thus, the alternative design preferably has insertion pocket openings that face forwards to accommodate the rear attachment lug.

In order to release the divider from the inserted position a front attachment lug has a sloping attachment face which in particular extends parallel to the upper attachment face as the leading slope, which causes the divider to rise at the rear end when pressure is exerted on the divider at the front end.

In the alternative embodiment described previously, a lower attachment face is provided which in particular slopes downwards and/or extends parallel to the upper attachment face. This makes it easier to disassemble the divider, since the lower attachment face functions as a leading slope when the attachment lug is pulled out, so that the divider is raised out of the channel by pulling on the front end of the divider.

If the rear fixing section includes a row of channels extending in the lengthwise direction of the article track or of the divider, installation is optimised further and/or simplified. The channels are dimensioned and arranged in such manner that the rear attachment lugs in them are guided into their insertion pockets and into the attachment position. In this context, it is particularly advantageous if the channels are aligned with the rear insertion pockets. In addition, a second, front attachment lug on the rear fixing element may engage in the channel in the inserted position, which has the effect of stabilising the divider more securely at the sides.

According to a further embodiment of the invention, the rear fixing element has parallel side faces or side walls. In particular, the rear fixing element is embodied as a punched metal sheet. This enables the divider to be offset laterally to very closely defined distances, wherein the rows of channels and rear insertion pockets are positioned at a distance corresponding to the thickness of the rear fixing elements.

According to a further aspect of the present invention, the front fixing section has a row of front insertion pockets, particularly extending in alignment with the rear insertion pockets to accommodate the front fixing element.

Ribbings may serve to reinforce the rear attachment lug and/or the front fixing element and/or the divider, particularly if these are embodied as punched metal sheets.

According to an advantageous embodiment, the divider is constructed as a U-shaped frame which includes

- a front leg, to which the front fixing section is attached,
- a rear leg, to which the rear fixing section is attached, and
- a longitudinal leg arranged between the front and the rear legs for guiding the articles along the article track.

The divider described in the preceding text is disclosed as an invention in its own right for the lateral delimitation of the article track of the article support surface, in particular with a front fixing element and a rear fixing element, wherein the rear fixing element has a rear attachment lug which is directed towards the front fixing element.

Figure 1B:
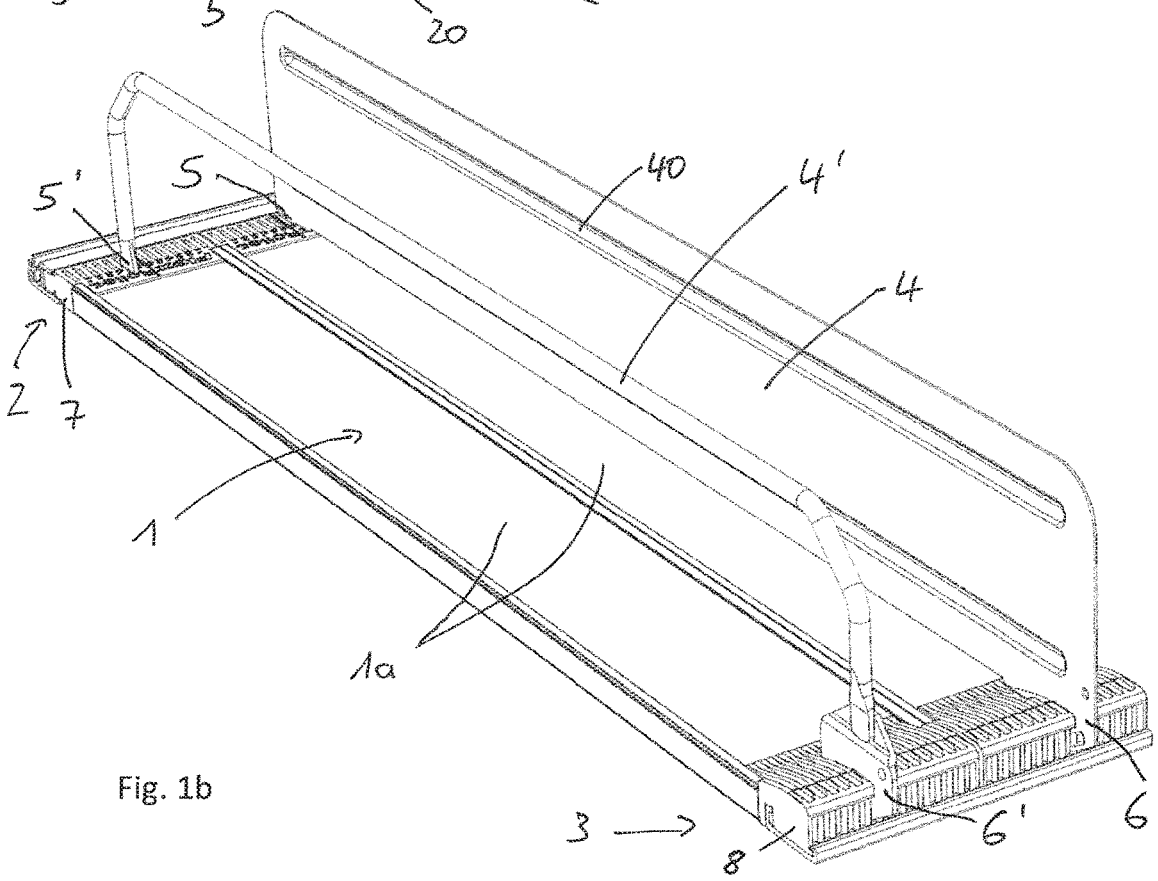
Figure 2A:
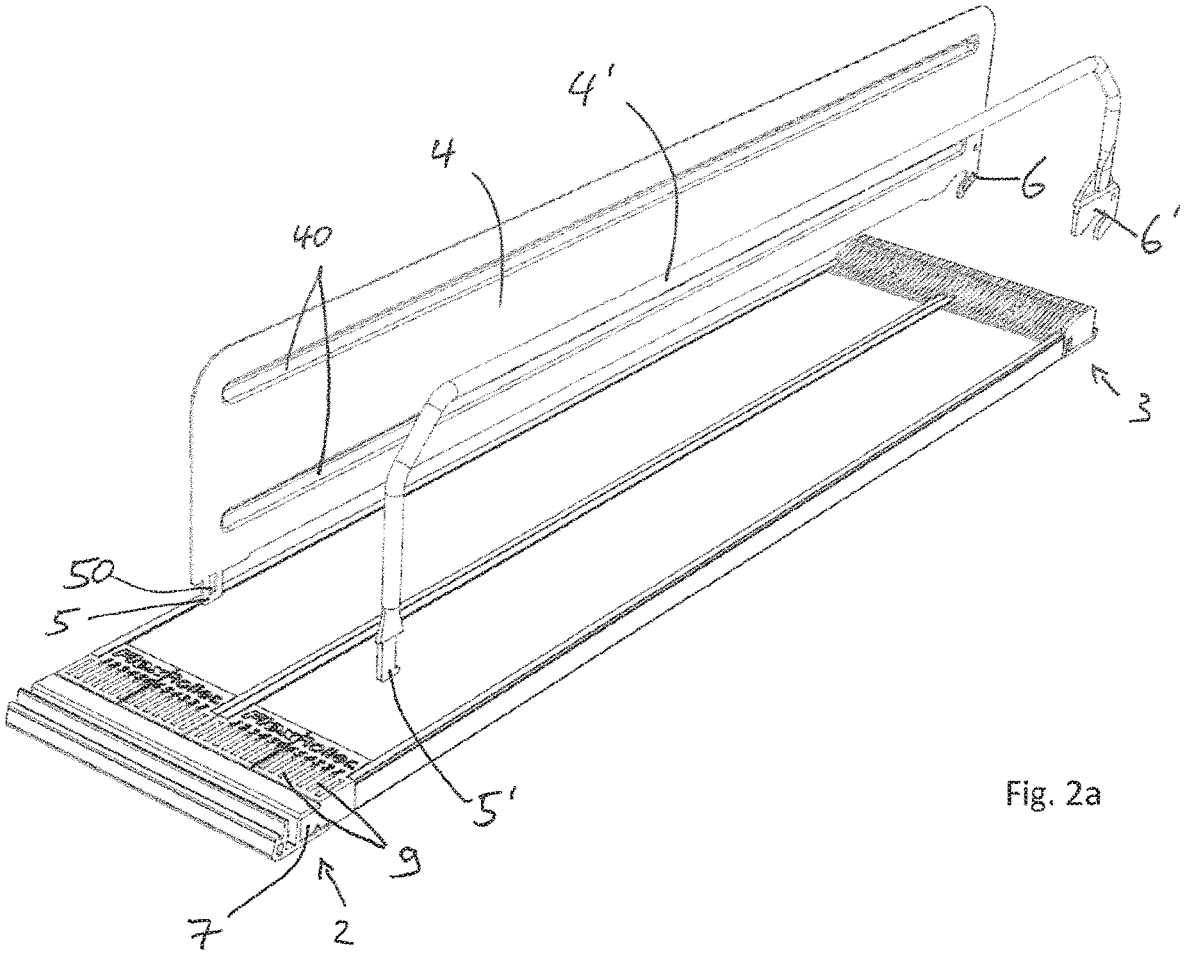
Figure 2B:
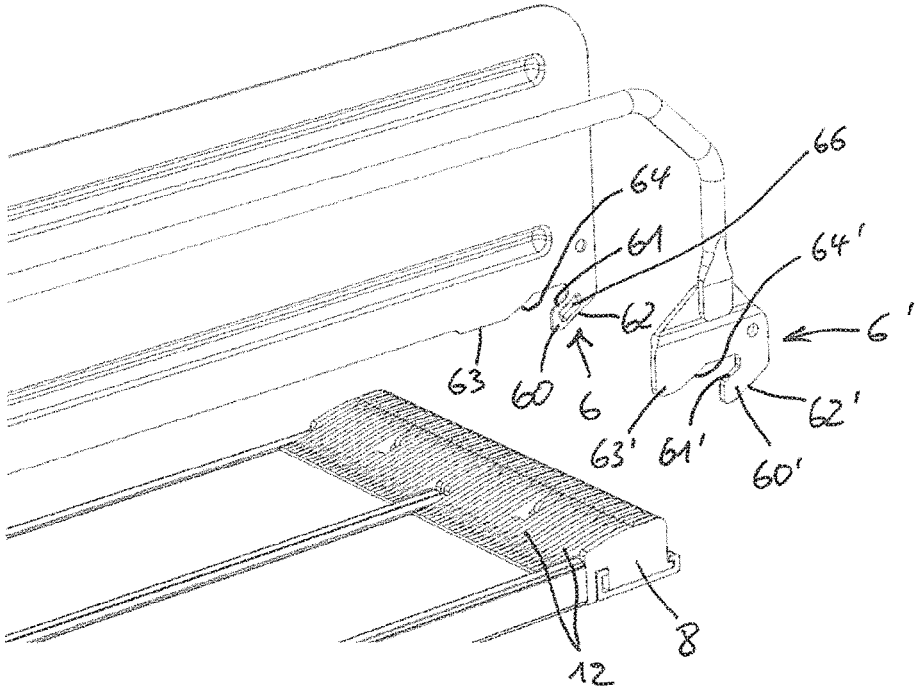
Figure 3:
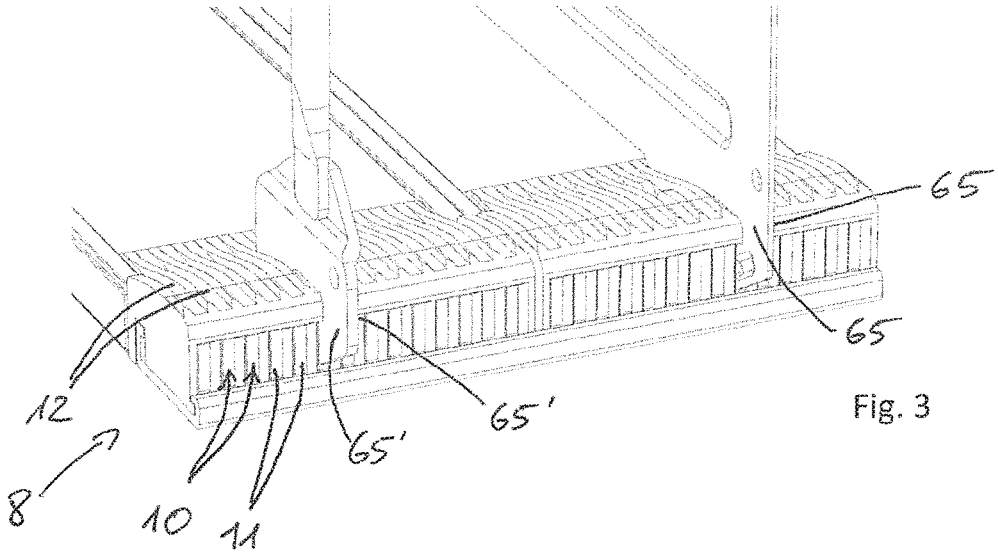
Figure 4A:
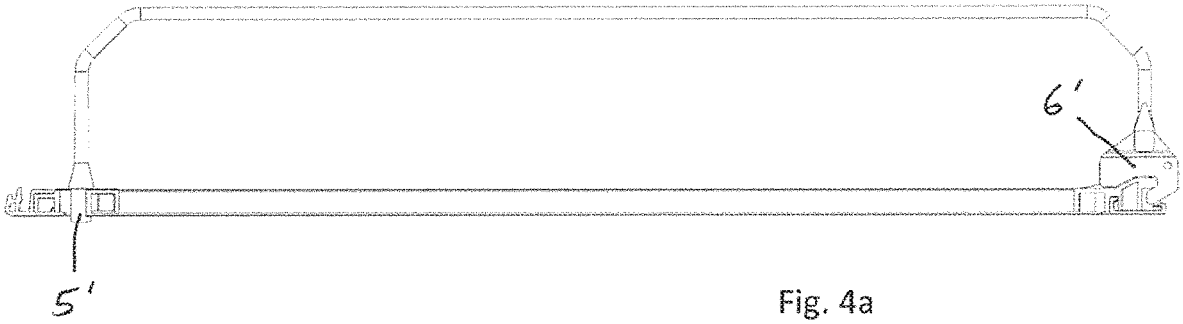
Figure 4C:
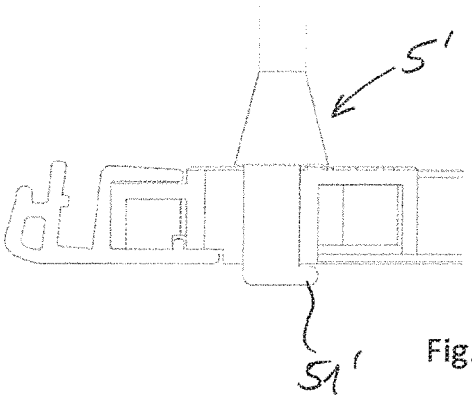
Figure 4B:
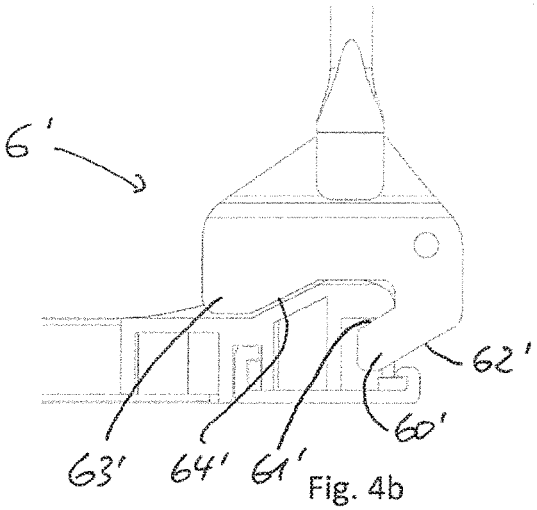
Figure 5A:
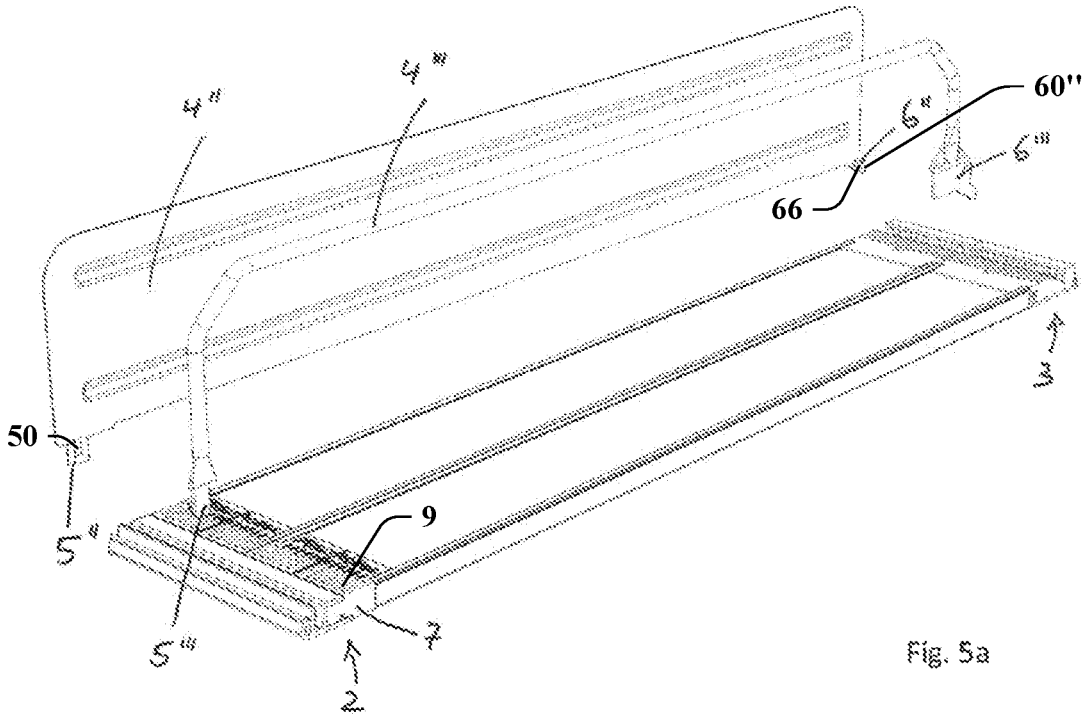
Figure 5B:
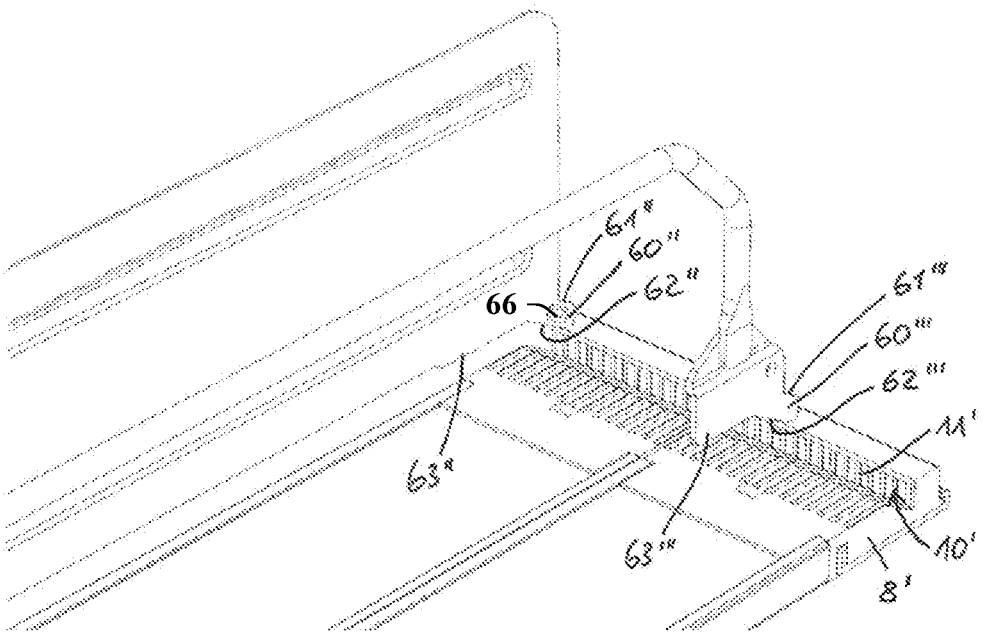
Figure 6:
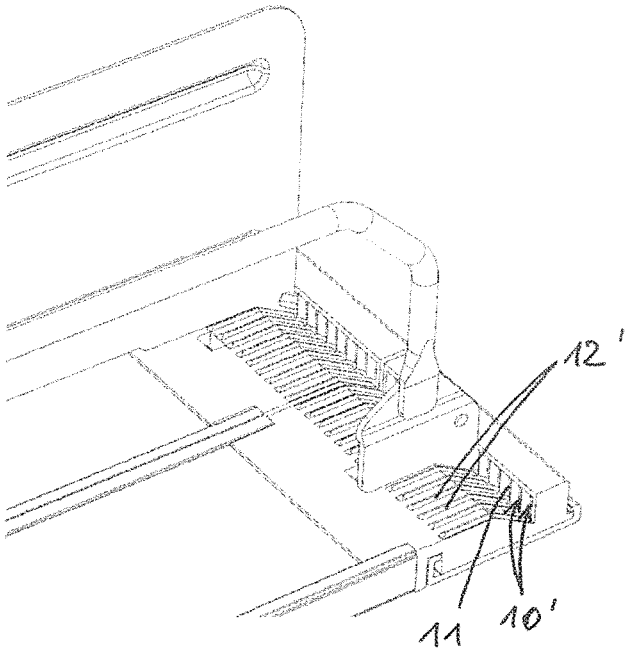
Figure 7A:
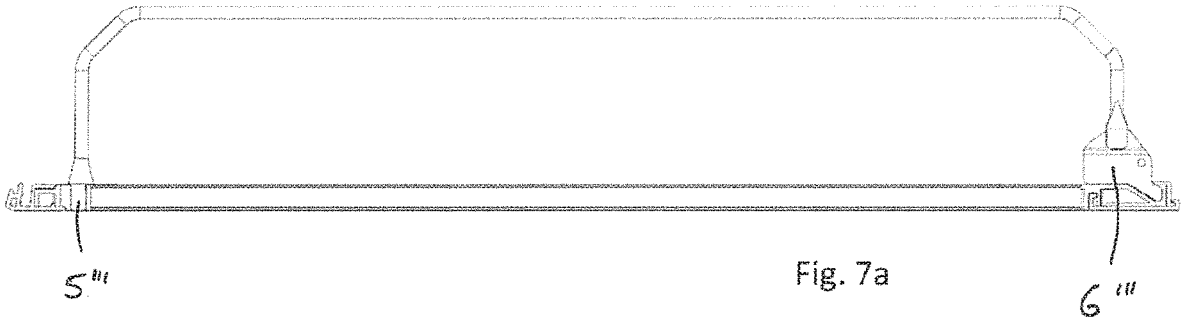
Figure 7C:
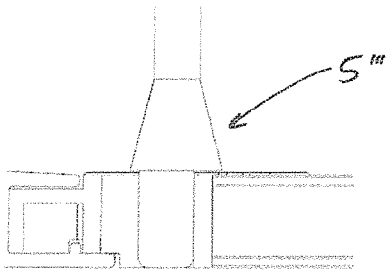
Figure 7B:
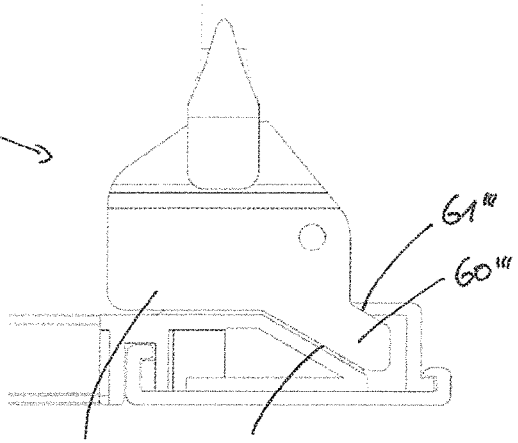

Further advantages, features and details of the invention are described in the following description of preferred exemplary embodiments and with reference to the drawing. In the drawing:

FIG. 1*a* shows an oblique frontal perspective view of a first embodiment of the system according to the invention, FIG. 1*b* shows an oblique rear perspective view of a first embodiment of the system according to the invention, FIG. 2*a* shows a perspective view of the first embodiment according to FIG. 1*a* with the dividers not fitted, FIG. 2*b* shows an enlarged representation of a rear end of the first embodiment according to FIG. 2*a*, FIG. 3 shows an enlarged representation of a rear end of the first embodiment in the fitted state, FIG. 4*a* shows a cross sectional view of the first embodiment according to FIG. 1*a*, FIG. 4*b* shows an enlarged representation of the rear end of the first embodiment according to FIG. 4*a*, FIG. 4*c* shows an enlarged representation of the front end of the first embodiment according to FIG. 4*a*, FIG. 5*a* shows a perspective view of a second embodiment of the invention with dividers not fitted, FIG. 5*b* shows an enlarged representation of a rear end of the second embodiment according to FIG. 5*a*, FIG. 6 shows an enlarged representation of a rear end of the second embodiment in the fitted state, FIG. 7*a* shows a cross sectional view of the second embodiment according to FIG. 5*a*, FIG. 7*b* shows an enlarged representation of the rear end of the second embodiment according to FIG. 7*a*, and FIG. 7*c* shows an enlarged representation of the front end of the second embodiment according to 7*a*.

In the figures, identical components or components with the same function are denoted with the same reference signs.

FIGS. 1*a* and 1*b* show a system which serves as an article presentation insert with an article support surface 1. The articles that are to be mounted on article support surface 1 are arranged in an article track which is delimited at the sides by dividers 4, 4', wherein the articles are arranged as far as possible on a front end 2 of the article track or the article support surface 1. In the present description, spatial indicators such as "front" and "rear" refer to the article support surface 1 and its front end 2, towards which the articles are to be transported or guided along the article track.

The articles are preferably conveyed in particular automatically towards the front end 2, wherein the movement of the articles is limited by a preferably transparent front panel, which is not shown. The front panel may particularly be fixed to the front end 2 by means of a fastening strut 20.

The dividers 4, 4' are in particular attachable solely to the front end 2 and to a rear end 3. A front fixing section 7 is arranged on the front end 2, and a rear fixing section 8 is arranged on the rear end 3.

The article support surface 1 in particular consists of several article carrier surfaces 1*a* arranged side by side, wherein a front end cap 1*v* on the front end 2 forms the front fixing section 7, and a rear end cap 1*h* on the rear end 3 forms the rear fixing section 8.

The left divider 4 shown in FIG. 2*a* is punched from a metal sheet and has two ribbings 40 for reinforcement. Ribbings 40 extend practically for the entire length of the divider 4.

A front fixing element 5 is conformed on the front end of the divider 4. This is embodied as a sheet metal extension with a ribbing 50, and thus has a very simple shape. In contrast to this, a rear fixing element 6 is of more complex construction. It has a rear attachment lug 60 which faces towards the front fixing element 5, and in particular is reinforced with a ribbing 66.

The rear attachment lug 60 has an upper attachment face 61 and a lower attachment face 62 arranged parallel thereto, both of which faces extend at an angle to a longitudinal axis of the divider 4 and at an angle to the article support surface 1.

The divider 4 also has a front attachment lug 63 with a sloping attachment face 64 on the rear fixing element 6.

The divider 4' illustrated on the right in FIG. 2*a* is constructed as a U-shaped frame with a front leg, a rear leg, and a longitudinal leg arranged between the front and the rear legs. The longitudinal leg serves to guide the articles along the article track. The front fixing element is attached to the front leg, and the rear fixing element is attached to the rear leg.

The longitudinal leg extends in particular parallel to the article support surface and serves to guide the articles along the article track.

The front leg and the rear leg extend substantially parallel to each other and are aligned at an angle of 90° with respect to the longitudinal leg.

The front fixing element 5' in particular has a flat shape with parallel side walls. A lock extension 51' (see FIG. 4*c*) particularly extending towards the rear fixing element 6' is provided on the lower end of the front fixing element 5'. In this way the front fixing element 5' may also be locked in place.

The rear fixing element 6' as a punched metal sheet or folded metal sheet is attached to the rear leg particularly by means of a welded joint.

Thus, the rear fixing element has two parallel side faces 65, 65', particularly on the area of a rear attachment lug 60' and a front attachment lug 63'.

The rear attachment lug 60' has an upper attachment face 61' and a lower attachment face 62' extending parallel thereto. The front attachment lug 63' has a sloping attachment face 64' which is arranged opposite the upper attachment face 61' and in particular parallel thereto.

The front fixing section 7 has a row of front insertion pockets 9, which are arranged side by side transversely to the article track. The front insertion pockets 9 have insertion pocket openings with an elongated shape, the longitudinal axis of which extends in the direction of the article track. The insertion pockets 9 are arranged side by side and in line with each other. The distance between adjacent front insertion pockets 9 is preferably in the range from 1.5 to 3 times the width of the insertion pocket openings. The front fixing elements 5, 5' may be fixed in the front insertion pockets 9, the width of the article track being adjustable by the selection of the front insertion pocket. The insertion pocket openings preferably face vertically upwards from the article support surface 1.

The rear fixing section 8 is shown enlarged in FIG. 3. The rear fixing section 8 has rear insertion pockets 10 with insertion pocket openings 11, which face away from the front fixing section 7 and rearwards from the rear end 3.

The rear attachment lugs 60, 60' may be accommodated in the rear insertion pockets 10, and similarly to the row of front insertion pockets 9 a row of rear insertion pockets are arranged in line and side by side with each other.

Channels 12 are also arranged in a row at the top of the rear fixing section 8 similarly to the insertion pockets 9, 10.

The dividers 4, 4' may be assembled in particular simply by grasping the dividers 4, 4' at the front end 2 and pushing the dividers 4, 4' towards the rear on the article support surface 1 until the rear attachment lug 60, 60' is moved beyond the rear fixing section 8, where the rear fixing element 6, 6' drops downwards. While the rear fixing element 6, 6' is pushed over the rear fixing section 8, the lower attachment face 62, 62' is aligned and guided by the channels 12. The slope of the lower attachment face 62, 62' causes the rear fixing element 6, 6' to rise automatically.

As soon as the rear attachment lug 60, 60' has been moved over the rear fixing section 8 and drops down, a pulling force can be applied to the front end 3 of the divider 4, 4', causing the rear attachment lug 60, 60' to engage in the rear insertion pocket 10 which is aligned with the channel 12, by which the rear fixing element 6, 6' was aligned previously.

The slope of the upper attachment face 61, 61' causes the rear fixing element 6, 6' to be pulled downwards, so that not only the rear attachment lug 60, 60' but also the front attachment lug 63, 63' is fixed in the rear fixing section 8. The front attachment lug 63, 63' engages in the corresponding channel 12, while the rear attachment lug 60, 60' engages in the corresponding rear insertion pocket 10. As soon as the attachment position or end position as shown in FIG. 4*b* has been reached, the front fixing element 5, 5' may be connected to the front fixing section 7. This occurs when the front fixing element 5, 5' engages in the front insertion pocket 9 which is aligned with the channel 12 and the rear insertion pocket 10.

In the case of the left divider 4, the front fixing element 5 is held in place in clamping manner by the ribbing 50, while for the right divider 4' a lock extension 51' is provided, which engages in locking manner with the front fixing section 7 as shown in FIG. 4*c*, as the lock extension 51' clasps behind the front insertion pocket 9. This may be effected by applying a pulling force to the front leg to bend the U-shaped frame of the divider 4' slightly open.

The left divider 4 "shown in FIG. 5*a* is constructed similarly to the divider 4 of FIGS. 2*a* to 4*c* except for a rear fixing element 6".

A front fixing element 5 "is conformed on the front end of the divider 4". The rear fixing element 6" has a rear attachment lug 60" which is directed away from the front fixing element 5", and which in particular is reinforced with a ribbing 66.

The rear attachment lug 60" has an upper attachment face 61" and a lower attachment face 62 "arranged parallel thereto, which attachment faces extend at an angle to a longitudinal axis of the divider 4" and at an angle to the article support surface 1.

The divider 4" also has a front attachment lug 63" on the rear fixing element 6".

The divider 4'" illustrated on the left in FIG. 5*a* is constructed similarly to the divider 4' of FIG. 2*a* except for the rear fixing element 6'" and the absence of a lock extension 51'.

The rear fixing element 6'" as a punched metal sheet or folded metal sheet is attached to the rear leg of the divider 4'", particularly by means of a welded joint.

The rear fixing element 6'" has a rear attachment lug 60'" which faces away from the front fixing element 5'". The rear attachment lug 60'" has an upper attachment face 61'" and lower attachment face 62'" extending parallel thereto. The rear fixing element 6'" also has a front attachment lug 63'".

An enlarged representation of rear fixing section 8' is shown in FIG. 5*b*. The rear fixing section 8' has rear insertion pockets 10' with insertion pocket openings 11', which face towards the front fixing section 7 and forwards from the rear end 3.

The rear attachment lugs 60", 60'" may be accommodated in the rear insertion pockets 10', wherein a row of rear insertion pockets 10' are arranged in line and side by side with each other similarly to the row of front insertion pockets 9.

Channels 12' are also arranged in a row at the top of the rear fixing section 8 similarly to the insertion pockets 9, 10, 10'.

The dividers 4", 4'" may be assembled in particular simply by grasping the dividers 4", 4'" at the front end 2 and applying a pushing force to the front end 2, thereby pushing the dividers 4", 4'" on the article support surface 1 in the channels 12' in guided manner towards the rear until the rear attachment lug 60", 60'" engaged in the rear insertion pocket 10' which is aligned with channel 12'.

The slope of the upper attachment face 61 ", 61'" causes the rear fixing element 6", 6'" to be pressed down, so that not only the rear attachment lug 60", 60'" but also the front attachment lug 63", 63'" are fixed in the Rear fixing section 8'. The front attachment lug 63", 63'" engages in the corresponding channel 12', while the rear attachment lug 60", 60'" engages in the corresponding rear insertion pocket 10'.

As soon as the attachment position or end position as shown in FIG. 7*b* has been reached, the front fixing element 5 ", 5'" may be connected to the front fixing section 7. This occurs when the front fixing element 5", 5'" engages in the front insertion pocket 9 which is aligned with the channel 12' and the rear insertion pocket 10'.

LIST OF REFERENCE SIGNS

1 Article support surface
1*a* Article carrier surface
1*v* Front end cap
1*h* Rear end cap
2 Front end
3 Rear end
4, 4', 4", 4'" Divider
5, 5', 5", 5'" Front fixing element
6, 6', 6", 6'" Rear fixing element
7 Front fixing section
8, 8' Rear fixing section
9 Front insertion pockets
10, 10' Rear insertion pockets
11, 11' Insertion pocket openings
12, 12' Channels
20 Fastening strut
40 Ribbing
50 Ribbing
51' Lock extension
60, 60', 60", 60'" Rear attachment lug
61, 61', 61", 61'" Upper attachment face
62, 62', 62", 62'" Lower attachment face
63, 63', 63", 63'" Front attachment lug
64, 64', 64", 64'" Sloping attachment face
65, 65', 65", 65'" Parallel side faces
66 Ribbing

The invention claimed is:

1. System comprising:

an article support surface for the arrangement of articles on a front end of the article support surface;

at least one article track that has a track width that is delimited and adjustable laterally by at least two dividers, each of the dividers having a respective front fixing element and a respective rear fixing element characterized in that the rear fixing elements each have:

a rear attachment lug facing towards the front fixing element of the respective divider and sloping at an angle with respect to a longitudinal axis of the respective divider; or a rear attachment lug facing away from the front fixing element of the respective divider and sloping at an angle with respect to the longitudinal axis of the respective divider;

a front fixing section arranged at the front end for fixing the front fixing elements of the at least two dividers; and a rear fixing section arranged at a rear end of the article support surface for fixing the rear fixing elements of the at least two dividers, the rear fixing section comprising:

a row of rear insertion pockets having:

insertion pocket openings facing toward a rear edge of the article support surface to accommodate the rear attachment lugs of the at least two dividers; or insertion pocket openings facing toward the front end of the article support surface to accommodate the rear attachment lugs of the at least two dividers; and a row of channels arranged along a top surface of the rear fixing section, the top surface of the rear fixing section having an incline with respect to a generally planar central portion of the article support surface that is located between the front fixing section and the rear fixing section, the channels extending lengthwise with respect to the at least one article track and arranged in line with the rear insertion pockets, the channels configured to guide the rear attachment lugs such that as the at least two dividers are pushed along the article support surface the channels guide the rear attachment lugs toward the rear insertion pockets.

2. System according to claim 1, wherein the rear attachment lug of each of the at least two dividers has at least one of:

an upper attachment face sloping down towards the article support surface; or a lower attachment face sloping down towards the article support surface.

3. System according to claim 1, wherein the rear fixing elements of the at least two dividers each have parallel side faces that define at least one of front attachment lugs of the rear fixing elements or the rear attachment lugs.

4. System according to claim 1, wherein the front fixing section has a row of front insertion pockets aligned with the rear insertion pockets for accommodating the front fixing elements of the at least two dividers.

5. System according to claim 1, wherein at least one of the rear attachment lugs of the at least two dividers has a ribbing.

6. System according to claim 1, wherein at least one of the at least two dividers (4, 4") is embodied as a punched metal sheet having elongated ribbings.

7. System according to claim 1, wherein at least one of the at least two dividers is a U-shaped frame comprising a front leg to which the front fixing section is attached, a rear leg to which the rear fixing section is attached and a longitudinal leg arranged between the front and the rear legs for guiding the articles along the at least one article track.

8. A shelf comprising:

an article support surface for the arrangement of articles on a front end of the article support surface;

a front fixing section arranged at the front end of the article support surface for fixing front fixing elements of at least two dividers; and a rear fixing section arranged at a rear end of the article support surface for fixing rear fixing elements of the at least two dividers, the rear fixing section comprising:

a row of rear insertion pockets having:

insertion pocket openings facing toward a rear edge of the article support surface to accommodate the rear fixing elements of the at least two dividers; or insertion pocket openings facing toward the front end of the article support surface to accommodate the rear fixing elements of the at least two dividers; and a row of channels arranged along a top surface of the rear fixing section, a bottom surface of the channels of the rear fixing section having an incline with respect to a generally planar central portion of the article support surface that is located between the front end and the rear end of the article support surface, the channels extending lengthwise with respect to the article support surface and arranged in line with the rear insertion pockets, for guiding the rear fixing elements such that as the at least two dividers are pushed along the article support surface the channels guide the rear fixing elements toward the rear insertion pockets.

9. System according to claim 1, wherein the channels are further configured to accommodate a front attachment lug of at least one of the at least two dividers.

10. System according to claim 1, wherein at least one of the front fixing elements of the at least two dividers has a ribbing.

11. System according to claim 2, wherein the lower attachment face slopes parallel to the upper attachment face.

* * * * *